United States Patent [19]

Deters

[11] 3,981,335

[45] Sept. 21, 1976

[54] LIQUID DISPENSING AND VAPOR RECOVERY SYSTEM UTILIZING AN INJECTOR AND A VALVE FOR PERMITTING OPERATION OF LEAK DETECTING APPARATUS

[75] Inventor: Elmer M. Deters, Muscatine, Iowa

[73] Assignee: Weil-McLain Co., Inc., Dallas, Tex.

[22] Filed: Mar. 31, 1975

[21] Appl. No.: 565,728

[52] U.S. Cl. ..... 141/46; 141/59; 222/318; 55/338; 55/184

[51] Int. Cl.[2] ..... B67D 5/04

[58] Field of Search ..... 222/52, 318; 141/7, 141/8, 37, 40–47, 50, 52, 53, 54, 55, 59, 115, 123, 137, 94, 197, 198, 287; 73/40, 40.5, 49.2, 49.3; 137/557; 220/85 VR, 85 VS; 55/338, 184

[56] References Cited

UNITED STATES PATENTS

| | | | |
|---|---|---|---|
| 2,401,124 | 5/1946 | Walker | 141/37 |
| 2,919,834 | 1/1960 | Rugeley et al. | 222/52 |
| 3,454,195 | 7/1969 | Deters | 222/52 |

*Primary Examiner*—Robert B. Reeves
*Assistant Examiner*—Charles A. Marmor
*Attorney, Agent, or Firm*—Lane, Aitken, Dunner & Ziems

[57] ABSTRACT

A liquid dispensing and vapor recovery system in which an underground storage tank is connected to a first conduit for delivering a liquid, such as gasoline, to a vehicle gasoline tank or the like under the force of a pump located in the storage tank. A second conduit is connected to the first conduit and to the storage tank for diverting a portion of the gasoline in the first conduit back to the storage tank and an injector is located in the second conduit for forming a reduced pressure zone in response to gasoline flow through the second conduit. A valve unit prevents the flow of gasoline through the second conduit until gasoline is delivered to the vehicle gasoline tank. A third conduit is connected to the vehicle tank and to the second conduit at the reduced pressure zone for drawing the vapors from the vehicle tank into the second conduit for passage into the storage tank.

7 Claims, 2 Drawing Figures

LIQUID DISPENSING AND VAPOR RECOVERY SYSTEM UTILIZING AN INJECTOR AND A VALVE FOR PERMITTING OPERATION OF LEAK DETECTING APPARATUS

BACKGROUND OF THE INVENTION

This invention relates to a liquid dispensing and vapor recovery system and, more particularly, to such a system in which liquid is dispensed from a storage tank to a receptacle while vapors from the receptacle are drawn to the storage tank.

With the increased emphasis on preventing pollution of the atmosphere, recent attention has been directed to minimizing the introduction of gasoline vapors into the atmosphere from both permanent type underground storage tanks for the gasoline, and from the vehicles into which the gasoline is ultimately dispensed.

Gasoline vapors can easily be recovered from underground storage tanks by providing a separate vapor return line which connects the storage tank to the transport truck which periodically fills the tank. In this manner, the gasoline introduced into the tank from the transport truck will displace the vapors and force them through the vapor recovery line to the truck whereby they are ultimately disposed of either by burning or through compression - refrigeration systems.

However, it has been extremely difficult to devise a satisfactory vapor recovery system from the gasoline tanks of vehicles. For example, previous proposals have utilized what is commonly referred to as a balanced displacement system in which the gasoline entering the tank forces the vapors through a separate line to the storage tank. However, this system has been less than satisfactory for several reasons, one of which is the difficulty in creating a proper seal between the gasoline dispensing and recovery nozzle and the automobile tank.

Although it has also been suggested to use a vacuum pump or a blower to remove the vapors from the vehicle tanks, this type of installation is disadvantageous from several standpoints. For example, the pump or blower is relatively expensive and creates potential safety problems due to the fact that it is electrically operated. Also, the output from the pump or blower is passed directly into the storage tank which pressurizes the tank and therefore increases vapor losses from the tank through its vent pipe.

Several recent developments have featured the use of an injector which establishes a reduced pressure zone in response to fluid flow from the storage tank to the vehicle receptacle, with the reduced pressure zone functioning to draw the vapors from the receptacle back to the tank. For example, in copending U.S. Pat. application Ser. No. 400,555, filed by Kirk Fowler and Elmer M. Deters on Sept. 25, 1973, and assigned to the same assignee as the present invention, and in copending U.S. Pat. application Ser. No. 534,448, filed by Trueman Hiller and Klaus Jarr on Dec. 19, 1974, and also assigned to the same assignee as the present invention, a gasoline dispensing and vapor recovery system is disclosed which incorporates such an injector.

Although both of these systems have considerably advanced the state of the art, they are incompatible with leak detector systems which are often incorporated in such installations. In particular, in the systems disclosed in the above applications, a portion of the flow from the main conduit extending from the storage tank to the vehicle receptacle is continuously diverted through the injector for establishing the reduced pressure zone before it is passed back to the storage tank. However, since the leak detector utilized in these type systems responds to pressure in the main conduit extending from the storage tank, the leak detector would be rendered inoperable since no such pressure is established by virtue of the continuous diversion of the flow.

SUMMARY OF THE INVENTION

It is, therefore, an object of the present invention to provide a liquid dispensing and vapor recovery system in which liquid is dispensed from a storage tank to a receptacle while vapors in the receptacle are recovered and delivered back to the storage tank.

It is a further object of the present invention to provide a liquid dispensing and vapor recovery system of the above type in which an injector is used to create a vacuum in response to the dispensing of the liquid from the storage tank to the receptacle, and is utilized to draw the vapors from the receptacle back to the tank.

It is a further object of the present invention to provide a liquid dispensing and vapor recovery system of the above type which can be used in installations of varying capacity, yet utilizes an injector of a relatively small size.

It is a further object of the present invention to provide a liquid dispensing and vapor recovery system of the above type which can be used in installations employing a leak detector which is responsive to pressures in the main gasoline delivery line.

It is a further object of the present invention to provide a liquid dispensing and vapor recovery system of the above type which is relatively simple in operation and relatively low in cost.

Toward the fulfillment of these and other objects, the system of the present invention comprises storage means for the liquid, first conduit means adapted to connect the storage means to a receptacle, pump means for pumping the liquid from the storage means through the first conduit means and to the receptacle, second conduit means connected to the first conduit means and to the storage means for diverting a portion of the liquid in the first conduit means back to the storage means, means for preventing the flow of said liquid through said second conduit means until the dispensing of said liquid by said dispensing means, means for forming a reduced pressure zone in the second conduit means in response to liquid flow through the second conduit means, and third conduit means connected to said second conduit means at the reduced pressure zone and to the receptacle for drawing the vapors from the receptacle into the second conduit means for passage into the storage means.

DESCRIPTION OF THE PREFERRED EMBODIMENTS

Figure 1:
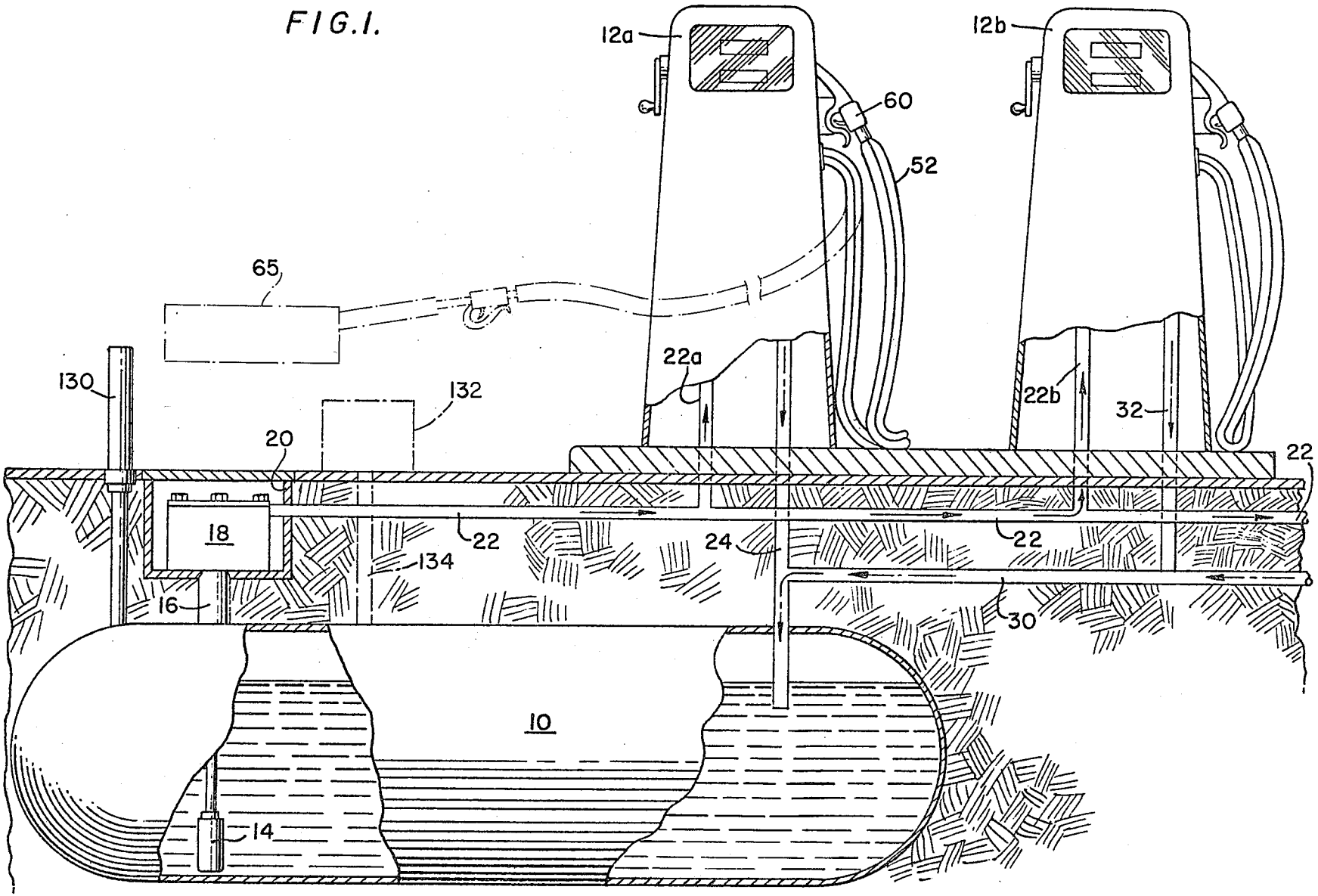
FIG. 1 is a partial schematic, partial elevational view of a service station installation having the dispensing and vapor recovery system of the present invention utilized therein.

As an example of the use of the liquid dispensing and vapor recovery system of the present invention, it will be described in connection with a gasoline dispensing installation for use in service stations or the like. Such an installation is illustrated in FIG. 1 and includes an underground tank 10 for storing a quantity of gasoline which is delivered to two dispensing units, or pedestals, 12*a* and 12*b*. An electrically operated, centrifugal type submersible pump 14 is disposed in the tank and operates to draw the gasoline into the unit through a plurality of intake ports disposed at the bottom thereof, and to force the gasoline upwardly around a sealed electrical drive motor.

A casing 16 is attached to the tank 10 and extends upwardly therefrom to connect the outlet of the pump 14 to a discharge head, or manifold, 18 which is preferably disposed below ground level in a wall 20. The manifold 18 is described in detail in U.S. Pat. No. 3,183,723, the disclosure of which is hereby incorporated by reference. Therefore, for the convenience of presentation, its structural details are not shown in the drawings, it being understood that it supports the upper portion of the pump unit 14 while permitting the electrical connections for the driven motor to be brought outwardly for connection to the proper controls. It is also understood that an adapter unit, or packer, is supported within the housing of the manifold 18 and has an inlet chamber communicating with the outlet of the pump 14, an inlet chamber adapted for registration with a substantially horizontal main conduit 22, and a check valve to permit the flow of gasoline from the pump 14 to the conduit 22 while preventing flow in the opposite direction, also in a conventional manner. It is further understood that a leak detector is mounted on the above-mentioned packer and operates to detect any leakage of gasoline from the system.

A pair of substantially vertical branch conduits 22*a* and 22*b* connect the main conduit 22 to the pedestals 12*a* and 12*b*, respectively, for delivering the gasoline to the pedestals.

A substantially vertical vapor recovery conduit 24 extends from the pedestal 12*a* into the tank 10 and terminates in the upper portion of the tank. A horizontal vapor recovery conduit 30 is connected to the conduit 24, and to a substantially vertical conduit 32 extending from the pedestal 12*b*, so that vapor from the latter pedestal is introduced into the conduit 24 for passage into the tank 10. It is noted from the drawings that in installations having more than two pedestals, the conduits 22 and 30 can be extended to connect with other vertical conduits of the additional pedestals.

Figure 2:
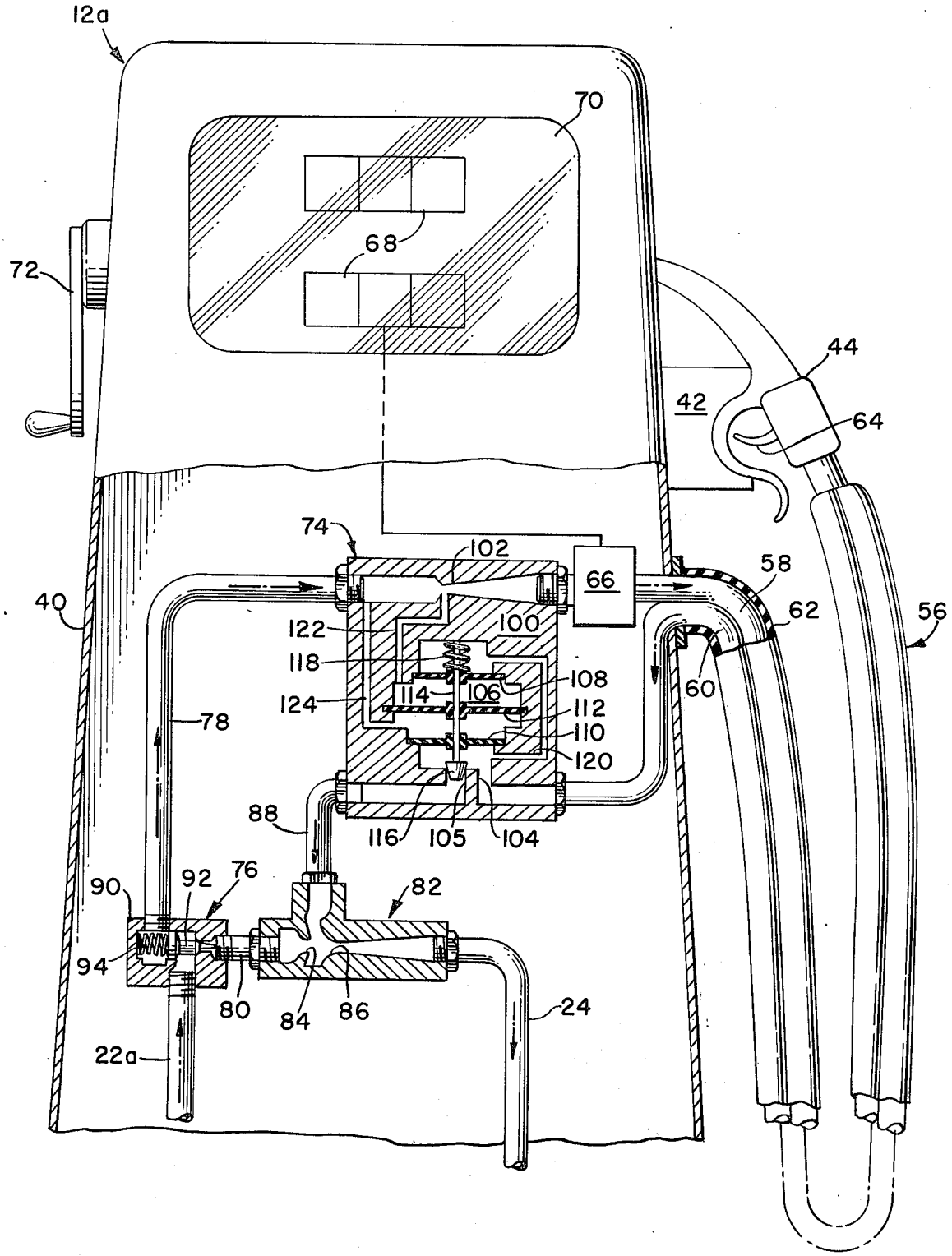
FIG. 2 is an enlarged, partial sectional, partial elevational view of a portion of dispensing unit utilized in the installation of FIG. 1, and incorporating the control unit of the present invention.

FIG. 2 depicts the details of pedestal 12*a*, it being understood that pedestal 12*b* is constructed in an identical manner. In particular, the pedestal 12*a* consists of a housing 40 having a support and switch assembly 42 supported on its upper outer surface which is adapted to support a dispensing unit 44. Although not shown in the drawings, it is understood that the assembly 42 includes a switch which operates to actuate the pump unit 14 in a conventional manner. The dispensing unit 44 is connected to one end of a hose assembly 56, with the other end portion of the latter assembly extending through and into the housing 40. The hose assembly 56 includes a pair of juxtapositioned hoses 58 and 60 surrounded by a protective cover 62. It is understood that the dispensing unit 44 includes a gasoline dispensing nozzle connected to the hose 58 and a vapor recovery conduit connected to the hose 60. The dispensing unit 44 is operated by a manually operated valve 64 in a conventional manner to dispense gasoline into the vehicle tank 65 in which it is inserted.

In the interior of the housing 40, the other end of the hose 58 is connected to the outlet of a meter 66 which is mechanically connected to a pair of registers 68 disposed behind a window 70 in the pedestal housing 40. The registers 68 are operated by a crank 72 and are adapted to display the quantity and cost of the gasoline dispensed. Since the meter 66 and the registers 68 are of a conventional design, they are not shown, nor will be described, in any further detail.

The end of the hose 60 extending within the housing 40 is connected to an outlet of a flow control unit 74 which will be described in detail later.

The branch conduit 22*a* is connected to a valve unit 76 in the housing 40, and a conduit 78 connects an outlet of the valve unit to an inlet of the flow control unit 74 for permitting a portion of the gasoline from the conduit 22*a* to be passed to the unit 74. The valve unit 76 is adapted to divert a portion of the gasoline received from the conduit 22*a* in a manner to be described in detail later, and has an additional outlet which registers with a relatively short bypass pipe 80.

An injector, shown in general by the reference numeral 82, has an inlet connected to the pipe 80 for receiving the diverted gasoline flow from the valve unit 76, and an outlet connected to the conduit 24 for passing the diverted gasoline back into the tank 10. A nozzle 84 and a venturi 86 are formed in the injector 82 and cooperate to form a reduced pressure zone at the throat portion of the venturi upon a flow of the gasoline through the injector in a conventional manner. A conduit 88 connects the injector 82 to the flow control unit 74 for reasons to be described in detail later.

The valve unit 76 consists of a housing 90 having a chamber formed therein which communicates with the inlet registering with the conduit 22*a*, the outlet registering with the conduit 78, and the outlet registering with the conduit 80. A valve member 92 is disposed in the latter chamber and has two portions adapted to cooperate with corresponding seats formed in the housing 90 for controlling the fluid flow from the inlet to both of the outlets. In particular, the valve member 92 has a frusto-conical stem portion that cooperates with a seat formed in the housing 90 and communicating with the outlet registering with the conduit 80. The latter stem portion is designed to permit a predetermined flow of gasoline to the conduit 80 in the open positions of the valve member 92 and to block flow to the latter conduit in the closed position of the valve member. The valve member 92 also has a head portion that cooperates with a seat communicating with the outlet registering with the conduit 78 for permitting flow to the latter conduit in the open position of the valve member. The above-mentioned head portion is sized relative to its seat so that, in the closed position of the valve member 92, a slight flow of gasoline to the conduit 78 occurs.

The valve member 92 responds to the difference in pressure between the gasoline in the conduit 22*a* and in the conduit 78, and a spring 94 is disposed in the housing 90 and urges the valve member in a direction from right to left as viewed in FIG. 2 to its closed position. The force applied by the spring 94 to the valve member 92 is insufficient to close the valve member against the force applied to the valve member by the fluid pressure in the conduit 22*a*, but is sufficient to close the valve member when the latter force is balanced by the force of the fluid pressure in the conduit 78, for reasons to be described in detail later.

Since the flow control unit 74 is manufactured as model SF1FEO1 by ITT General Controls of Glendale, Calif., and, per se, does not form any portion of the present invention, it will be described only generally as follows. The unit 74 includes a housing 100 having a venturi passage 102 defined therein which has an inlet portion connected to the conduit 78 for receiving the gasoline, and an outlet for supplying the gasoline to the meter 66.

The flow control unit 74 also defines an inlet port 104 which registers with the hose 60 for receiving vapors from the dispensing unit 44, and an outlet port 105 which registers with the conduit 88 extending from the injector 82. The interior of the housing 100 is hollow and define a chamber 106 which is bounded by a pair of membranes 108 and 110 mounted to corresponding surfaces defined within the housing. The chamber 106 is divided into an upper and lower portion by a central membrane 112 extending across the chamber 106 and supported along its edge portions within a slot formed in the housing. A valve stem 114 is disposed in the chamber 106, extends through openings in the membranes 108, 110, and 112, and is secured to the membranes. A valve head 116 is disposed at the end of the stem 114 and cooperates with the outlet port 105 to regulate the flow of vapor through this port. A spring 118 extends between a surface defined in the housing 100 and the membrane 108 to normally urge the latter membrane, and therefore the valve stem 114 and the valve head 116 into a closed position relative to the outlet port 105.

A passage 120 connects the chamber defined above the membrane 108 to the chamber defined below the membrane 110 for equalizing the vapor pressures in these chambers. A passage 122 connects the reduced pressure zone of the venturi passage 102 to the upper portion of the chamber 106, and a passage 124 connects the lower portion of the chamber 106 to the venturi passage 102 upstream of the reduced pressure zone, for the purposes of creating a pressure differential across the membrane 112 in response to the flow of gasoline through the venturi passage 102. As a result of this latter flow, the membrane 112 and therefore the valve stem 114 and valve head 116 are urged upwardly against the force of the spring 118.

In operation, upon an operator releasing the dispensing unit 44 from its support and switch assembly 42 on the pedestal 12*a*, for example, and actuating the associated switch, the pump 14 will be actuated to pump gasoline from the tank 10, through the manifold 18 and the leak detector associated therewith, and through the conduits 22 and 22*a*. During the initial operation of the pump 14 and before the valve 64 is actuated to commence dispensing of the gasoline from the dispensing unit 44, the fluid pressure in the conduit 22*a* will force the valve member 92 to move in a direction from right to left as viewed in FIG. 2, to its open position where it permits gasoline to flow into the conduits 78 and 80. The pressure in the conduit 78 will rapidly build up and, when sufficient to balance the pressure in the conduit 22*a*, the force of the spring 94 will urge the valve member 92 to the right to its closed position. The slight flow past the head portion of the valve member 92 and into the conduit 78 will maintain this pressure balance and the pressure in the conduit 22*a* will thus build up to an extent that the leak detector can operate to detect the presence or absence of a substantial leak in the system, as disclosed in the above-identified patent. Assuming that no substantial leak in the system does, in fact, exist, upon actuation of the valve member 64 of the dispensing unit 44, the gasoline in the conduit 78 will pass into flow control unit 74. As a result, the pressure in the conduit 78 will be relieved and the pressure in the conduit 22*a* will force the valve member 92 to an open position to permit a continuous flow of gasoline through the valve unit 76, the conduit 78, and into the flow control unit 74.

In the flow control unit 74, the gasoline will pass through the venturi passage 102 and then exit before passing through the meter 66, the hose 58, and the dispensing unit 44 for introduction into vehicle gasoline tank.

In the foregoing operation when the valve member 92 is open, a portion of the gasoline flowing from the valve unit 76 will be diverted into the pipe 80 and will pass into the injector 82, where it passes through the nozzle 84 and the venturi 86 before passing into the vapor recovery conduit 24 and back to the tank 10. As a result, a reduced pressure zone will be formed in the injector 82 which is transferred, through the conduit 88 and the flow control unit 74, to the hose 60. This reduced pressure zone, plus the force of the gasoline as it displaces the vapors from the vehicle tank, will cause the vapors to pass from the vehicle tank into and through the hose 60 where it passes into the inlet port 104 of the flow control unit 74.

If the differential pressure created across the membrane 112 by virtue of the positive pressure applied to the lower portion of the chamber 106 via the passage 124, and the negative pressure applied to the upper portion of the chamber 106 via the passage 122 is of sufficient magnitude, the membrane 112 and therefore the valve head 116 will be urged upwardly against the force of the spring 118 to expose a portion of the outlet port 105. This permits the vapors to flow from the inlet port 104, through the outlet port 105 and the conduit 88, and to the injector 82, with the amount of vapor flowing being modulated by the valve head 116 in response to the flow of gasoline through the flow control unit 74.

In the injector 82, the vapors pass through the venturi portion 86 where they are partially absorbed by the gasoline passing through the injector. The resulting mixture then passes from the injector 82, through the conduit 24, and into the tank 10. The vapors are at least partially absorbed by the gasoline passing through the injector 82 and the line 24 and those vapors not absorbed will either condense in the tank 10 or can be recovered by the gasoline transport truck in the manner discussed above.

Any change in the flow rate of the gasoline passing through the conduit 22*a* will be accompanied by a corresponding change in the position of the valve head 116 relative to the outlet port 106. As a result, the amount of vapor drawn from the vehicle tank by the injector 82 is modulated in proportion to the gasoline flow through the system.

It is thus seen that several advantages are achieved by virtue of the combination of the flow control unit 74, the valve unit 76, and the injector 82. For example, a precise portion of the amount of vapor recovered can be achieved, thus permitting the system to be used in installations of varying capacity. Also, an optimum negative pressure can be maintained in the vapor recovery line to insure full recovery of the vapors while eliminating the possibility of pressurizing the tank 10 or damaging the vehicle tank by virtue of a too high negative pressure occurring. Further, the above advantages are achieved while permitting a leak detector of the above type to be utilized in the system.

It is noted from FIG. 1 that the storage tank 10 is provided with a vent pipe 130 for exhausting vapor from the tank which may form due to diurnal losses and that an optional condenser system 132 may be provided which is connected to the tank 10 via a line 134 and which operates to condense any excessive vapors in the tank 10. Since this type of condenser system is well known in the art, it will not be described in any further detail.

It is understood that the use of the valve unit 76 is not limited to the specific environment discussed above, but can be incorporated in any system in which an injector is used. It is also understood that the system of the present invention is not limited to the dispensing of gasoline and the recovery of gasoline vapors but could be applied to any installation, such as chemical plants, or the like, in which vapor recovery is desired.

Of course, other variations of the specific construction and arrangement of the system disclosed above can be made by those skilled in the art without departing from the invention as defined in the appended claims.

I claim:

1. A liquid dispensing and vapor recovery system comprising storage means for said liquid, dispensing means for dispensing said liquid to a receptacle, first conduit means adapted to connect said storage means to said dispensing means, pump means for pumping said liquid from said storage means through said first conduit means and to said dispensing means, second conduit means connected to said first conduit means and to said storage means for diverting a portion of said liquid in said first conduit means back to said storage means, a housing defining a first passage forming a portion of said first conduit means and a second passage communicating with said first passage and forming a portion of said second conduit means, first valve means disposed in said first passage and movable in response to changes in the flow rate of said liquid through said first conduit means, means responsive to the absence of a predetermined liquid flow rate in said first conduit means for urging said first valve means to a position in said first passage in which the flow of liquid through said first conduit means is reduced, second valve means disposed in said second passage and movable in response to said movement of said first valve means for preventing the flow of liquid through said second passage upon said first valve means moving to said position, means for forming a reduced pressure zone in said second conduit means in response to liquid flow through said second conduit means, third conduit means connected to said reduced pressure zone and to said receptacle for permitting the vapors in said receptacle to pass from said receptacle into said second conduit means for passage into said storage means, and means operatively associated with said third conduit means for continuously changing the flow rate of the vapors in said third conduit means in response to changes in the flow rate of liquid through said first conduit means.

2. The system of claim 1 wherein said means for continuously changing the flow rate of the vapors in said third conduit means comprises a valve seat disposed in said third conduit means, a valve member disposed in said third conduit means and cooperating with said valve seat, and means associated with said first conduit means and said valve member for moving said valve member relative to said seat in response to changes in the flow rate of liquid through said first conduit means.

3. The system of claim 2 wherein said means for moving said valve member comprises means defining a chamber externally of said conduit means, a membrane disposed in said chamber and connected to said valve member, and a venturi formed in said first passage means in communication with said chamber for creating a negative pressure in the chamber in response to liquid flow through said first passage means to move said membrane and therefore said valve member.

4. The system of claim 1, wherein said second valve means is formed integral with said first valve means.

5. The system of claim 1, wherein said means for forming a reduced pressure zone comprises a nozzle and a venturi disposed in said second conduit means.

6. The system of claim 1, wherein said dispensing means includes a portion of said third conduit means.

7. The system of claim 1, wherein said liquid is fuel, said storage means is an underground storage tank, and said receptacle is a vehicle fuel tank.

* * * * *

UNITED STATES PATENT OFFICE
CERTIFICATE OF CORRECTION

Patent No. 3,981,335 Dated September 21, 1976

Inventor(s) Elmer M. Deters

It is certified that error appears in the above-identified patent and that said Letters Patent are hereby corrected as shown below:

Column 3, line 20, "wall" should read -- well --.

Column 3, line 27, "driven" should read -- drive --.

Column 3, line 32, "inlet" should read -- outlet --.

Column 5, line 20, "define" should read -- defines --.

Signed and Sealed this

Eleventh Day of January 1977

[SEAL]

*Attest:*

RUTH C. MASON
*Attesting Officer*

C. MARSHALL DANN
*Commissioner of Patents and Trademarks*